United States Patent [19]

Pies

[11] Patent Number: 4,767,021

[45] Date of Patent: Aug. 30, 1988

[54] CONTAINER

[75] Inventor: Gunther Pies, Frechen-Freimersdorf, Fed. Rep. of Germany

[73] Assignee: Mauser-Werke GmbH, Bruhl, Fed. Rep. of Germany

[21] Appl. No.: 113,793

[22] Filed: Oct. 27, 1987

[51] Int. Cl.[4] ..... B65D 25/00

[52] U.S. Cl. ..... 220/465; 220/5 R; 220/66

[58] Field of Search ..... 220/465, 466, 1 B, 5 R, 220/5 A, 66, DIG. 1, DIG. 6

[56] References Cited

U.S. PATENT DOCUMENTS

| | | | |
|---|---|---|---|
| 997,556 | 7/1911 | Hoyer | 220/465 |
| 2,124,565 | 7/1938 | Goll et al. | 220/465 |
| 2,132,722 | 10/1938 | Coakley | 220/466 X |
| 2,146,381 | 2/1939 | Rheem | 220/466 X |
| 2,711,264 | 6/1955 | Benson | 220/5 R |
| 3,170,586 | 2/1965 | Bulgrin | 220/66 X |
| 4,201,306 | 5/1980 | Dubois et al. | 220/66 X |

*Primary Examiner*—Steven M. Pollard

*Attorney, Agent, or Firm*—Pennie & Edmonds

[57] ABSTRACT

A container, in particular a drum, having at least one bung in the top head and a central head surface arched inwardly and an adjoining outer head surface sloping obliquely to the shell or wall of the container. The bung is arranged in a funnel-shaped elevation on the top head and a drainage channel is provided in the transition region between the central and outer head surfaces. The channel has a continual slope toward the bung to direct liquid to the bung when the container is inverted.

5 Claims, 3 Drawing Sheets

CONTAINER

BACKGROUND OF THE INVENTION

The invention relates to liquid containers and more particularly to liquid containers constructed to allow complete drainage of the container contents thus reducing drainage residue.

The complete drainage of containers has assumed paramount importance. Due to the increasing use of containers as multi-use vessels ever greater amounts of drainage residues are produced, resulting in an unacceptable volume of waste. When a large amount of hazardous waste is involved the volume of waste may assume proportions difficult to manage.

The steps previously taken to solve this problem have not been satisfactory. Attempts have been made to drain residual liquid through the fill and drainage bung of the container by turning the container upside down. In so doing the container had to be moved back and forth to get the residual liquid into the aperture of the bung. It is not possible to obtain an adequate drainage of residues in this manner.

According to a previous design, a container having a specially designed top head has been developed in which the residual liquid is designed to be collected and guided to the bung. For this purpose the central head region has been arched inward, while the outer region adjoining the arched central region slopes obliquely to the wall surface of the container.

When such a container is tipped upside down the residual liquid does indeed collect in the deepest part of the top head, between the arched central region and the outer oblique region and a considerable portion thereof flows through the bung aperture. Even though appreciable improvements have been achieved thereby, additional handling of the container is still required to fully remove the residue.

The problems of drainage of residues is of special importance in the case of drums having two bungs in the head portion of the drum. In this connection, too, according to the previous proposal the central region lying between the bungs has been arched inward, while the outer region adjacent to the arch slopes obliquely to the surface of the drum.

It is an object of the present invention to provide simple means for the optimal drainage of residues from containers while maintaining the stable equilibrium position of a container standing on its head. It is another object of the invention to avoid additional manipulation of the container once it has been inverted, inasmuch as the position of the bung in this orientation can no longer be determined and when the position of the bung is unfavorable, swinging motions are ineffective to assist drainage.

SUMMARY OF THE INVENTION

Pursuant to the invention, these objects are accomplished by providing a container having a bung which is arranged in a funnel-shaped elevation of the top head of the container or drum, and a drainage channel impressed in the transition between central head and outer head surface regions having a drainage slope to carry the residue to the bung when the drum is inverted.

In such a container standing inverted on the floor, the funnel-shaped elevation forms the deepest spot in the top head of the container. The drainage channel guides the collected residual liquid into the funnel-shaped elevation of the bung and out through the bung aperture. The drainage channel has a continual slope over its length from the end of the channel farthest from the bung.

In a drum having two bungs at the head, that is a fill and drainage bung and a second venting bung, the inner edge of the venting bung at its connection to the funnel-shaped elevation is at least as high as the inner edge of the fill and drainage bung when the drum is in its upright position. This measure is intended to ensure that when the drum is inverted the residual liquid is guided to the smaller venting bung. Since the latter is as a rule not opened for the normal withdrawing of liquid contained in the drum, the opened venting bung indicates that drainage of the residues has been effected. The closed venting bung shows that drainage has not yet been effected.

In order to utilize existing drum storage, filling, transport and drainage devices, standard drum dimensions must be retained. Also, the bung positions in the top head of the drum and the vertical distance of the upper outer most edge of the fill and discharge aperture of the bung from the upper edge of the drum must be retained in order to accommodate existing filling devices. In the preferred embodiment, the incline of the slope of the drainage channel is governed by the funnel depth which in turn is obtained from the difference in overall height of the two bungs as measured from the upper outermost edge of each bung and with these edges being in a common plane.

DETAILED DESCRIPTION OF THE INVENTION

Figure 1:
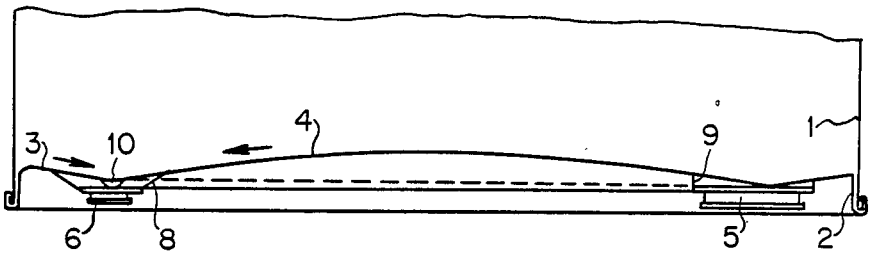
FIG. 1 shows the cut-away section of the head of an inverted drum along section 1—1 of FIG. 2.
Figure 2:
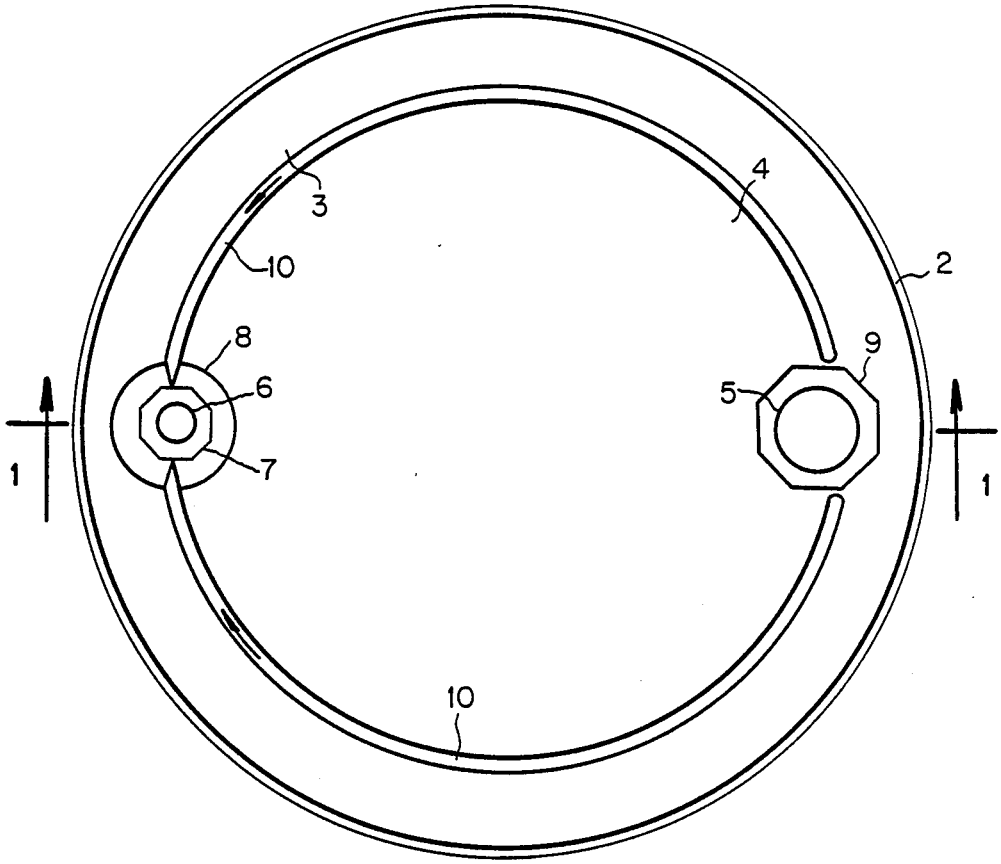
FIG. 2, the top view, from inside the drum head of FIG. 1.

A deep-drawn top head 2 is folded into the drum shell 1. Bung rings 5*a* and 5*b* of the fill and discharge bung 5 and of the smaller venting bung 6 are rolled into the top head 2. Hexagonal flanges of the bung rings are fixed in bung pockets 7 and 9 of the top head 2.

A circular, central head surface 4 of the top head 2, as viewed with the container in its upright position, is arched downwardly toward the central interior of the drum. The outer peripheral edge of the central head surface 4 is adjoined by an annular outer head surface 3 which is inclined downwardly toward the shell 1 of the drum. In this way a raised transition region is formed between the central and outer head surfaces, which when the container is inverted, forms an annular depression in the inside of top head 2. Thus, when upside down, the residual liquid flows together in the direction of the arrows shown in FIGS. 1, 2, 5 and 6. The top head design is symmetric in order to simplify manufacturing.

Figure 3A:
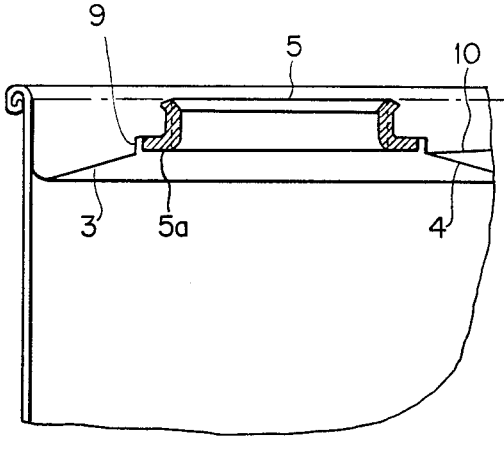
FIGS. 3A and 3B are enlarged cut-aways of the bungs of FIG. 1.
Figure 3B:
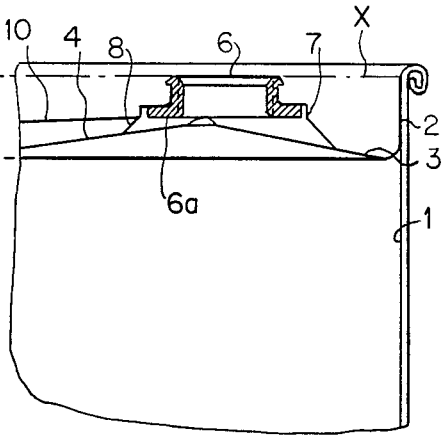
Figure 4A:
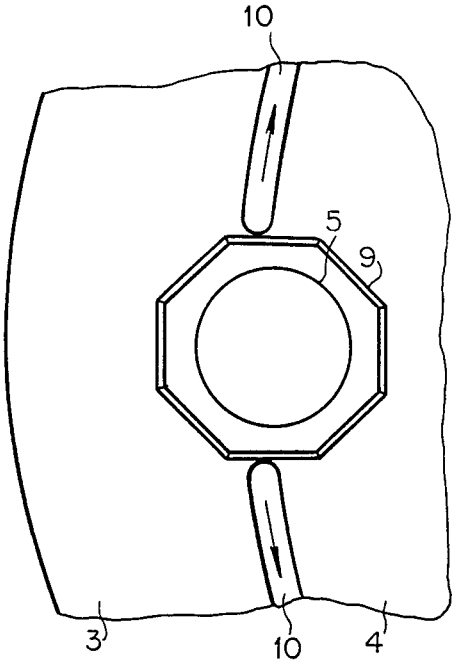
FIGS. 4A and 4B are the top views, from inside the bung cut-aways of FIGS. 3A and 3B.
Figure 4B:
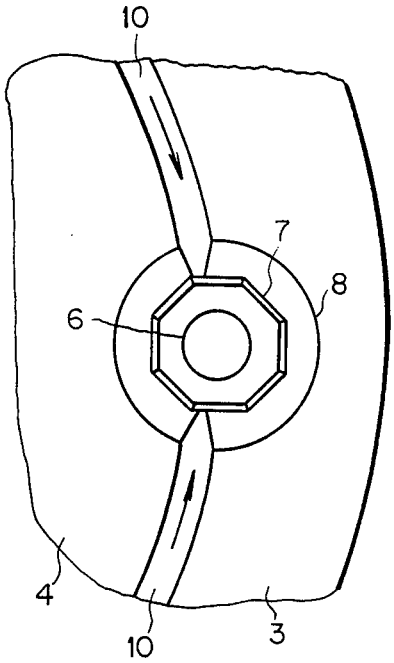

The bungs 5 and 6 are disposed in the raised transition region with the venting bung 6 being shorter in overall height that the bung 5. With reference to FIGS. 3A and 3B, the height of the bungs is measured from their outermost ends in the common plane X to the innermost edges of their respective pocket portions 7 and 9. The innermost edge of the bung pocket 9 of the bung 5 connects directly to and exhibits no projection inwardly of the transitional region between the central surface 4 and the annular outer surface 3. In contrast, the innermost edge of the pocket 7 of the venting bung 6 connects to one end of a funnel-shaped elevation 8, the other end of which connects to the transition region between the central and outer surfaces 4 and 3. In the example, the depth of the funnel-shaped elevation results from the difference in the overall height of the bungs 5 and 6.

In the raised transition region between the central head surface 4 and the outer, annular surface 3 a drainage channel 10 is formed in two sections which extend in opposite directions from the bung 5 to the venting bung 6. In the upright position of the drum, the drainage channels are at a higher level than the raised transition region while in the inverted position, the channels are at a depressed, lower elevation relative to the transition region. The sections of the drainage channels 10 run with continual slope from the vicinity of the pocket 9 of the bung 5 into the funnel-shaped elevation 8 of the venting bung 6. It should be noted that the ends of the channels adjacent the pocket 9 are farthest from the bung 6. Therefore, when the container or drum is inverted, the channel will collect residual liquid from all locations and direct it along a sloping path toward the venting bung 6. Thus, in the inverted position of the container, the innermost edge of the venting bung will be at a lower level than the innermost edge of the bung 5. This together with the sloping nature of the drainage channel assures complete removal of residue liquid from the container. In the embodiment shown in FIGS. 1 and 2 the funnel depth determines the degree of slope in the drainage channel 10. The collected liquid, moving in the direction of the arrows in FIG. 2, reaches the elevation 8 and from there exits the container through the bung 6.

Figure 5:
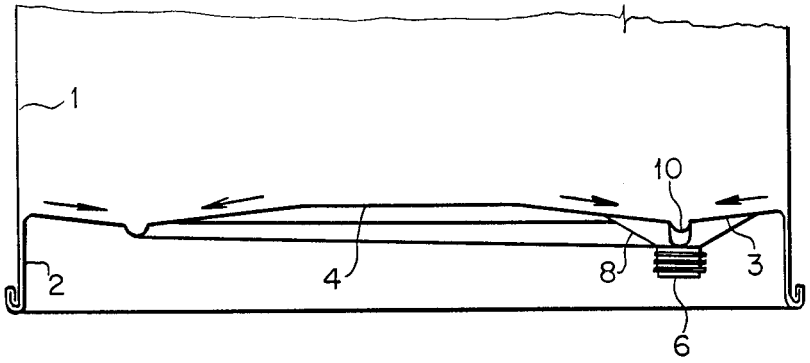
FIG. 5, the head cut-away section of an inverted rectangular container along section 5—5 of FIG. 6.
Figure 6:
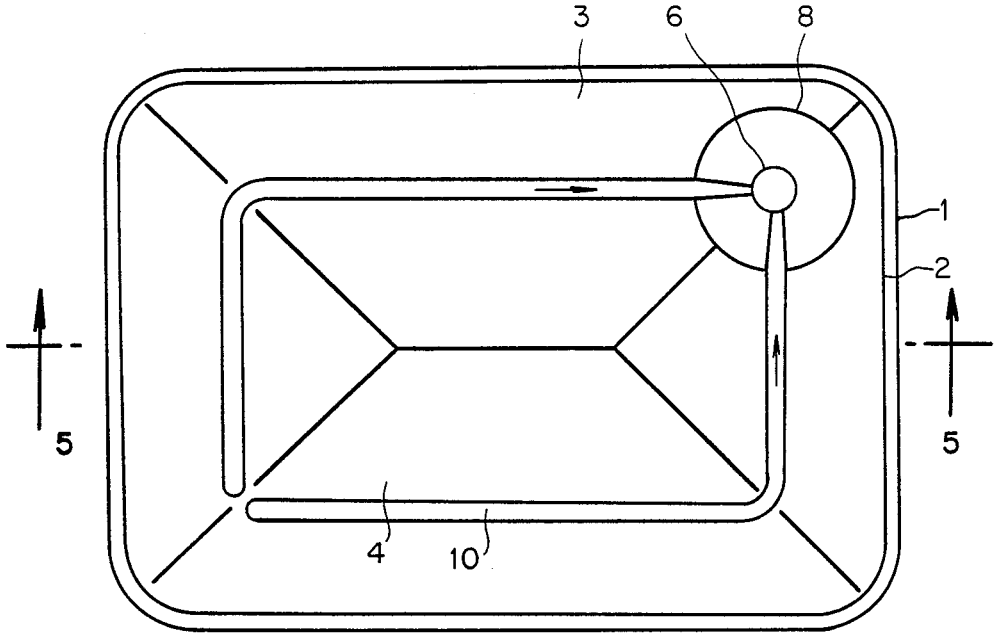
FIG. 6, the top view, from inside the rectangular container head of FIG. 5.

In FIGS. 5 and 6 a rectangular container is illustrated whose central head surface 4 is arched inwardly in the shape of a hip-roof. The outer head surface 3 adjoining the central head surface 4 is inclined obliquely to the shell 1 of the container as in the embodiment of FIG. 1. A drainage channel 10 having a continual slope and emptying into the funnel-shaped elevation 8 is impressed into the transition region between central head and outer head surfaces 4 and 3. The beginning of the channel 10 lies in the part of the transition region farthest removed from the bung 6 and includes two sections extending in opposite directions toward the venting bung 6. In the embodiment of FIGS. 5 and 6, this part lies on the diagonal facing the bung 6.

I claim:

1. In a container having a shell and at least one bung in a top head with a central head surface arched inward and an outer head surface, adjoining the arched central head surface, tapering off obliquely to the shell of the container and forming a raised transition region between the central head surface and the outer head surface when the container is viewed in an upright position, the improvement comprising:

(a) a funnel-shaped elevation disposed in the top head in the transition region and connecting the bung to the central and outer head surfaces; and (b) a drainage channel in said raised transition region, said drainage channel being depressed at a lower elevation relative to said transition region when said container is in an inverted position and having a continual downward slope beginning in a portion of the transition region farthest from the bung and emptying into the funnel-shaped elevation.

2. The container according to claim 1 wherein the drainage channel includes:

(a) two channel sections extending in opposite directions from the portion of the transition region farthest from the bung.

3. In the container according to claim 1 wherein first and second bungs are provided in the top head, the improvement wherein:

(a) the first bung has an innermost edge connected directly to the transitional region between the central and outer head surfaces;

(b) the second bung has an innermost edge connected to one end of said funnelshaped elevation with the other end of said elevation connected to said transition region; and (c) the innermost edge of said second bung is at a lower level than the innermost edge of the first bung when the container is in an inverted position.

4. The container according to claim 3 wherein;

(a) the first bung is a filling and emptying bung; and (b) the second bung is a venting bung.

5. The container according to claim 4 wherein:

(a) the drainage channel includes two channel sections extending in opposite directions from said filling and emptying bung to said venting bung.

* * * * *